US009169755B2

(12) United States Patent
Ulrey et al.

(10) Patent No.: US 9,169,755 B2
(45) Date of Patent: *Oct. 27, 2015

(54) WATER INJECTION FOR CATALYST OXYGEN REDUCTION AND TEMPERATURE CONTROL DURING TRANSIENT EVENTS

(71) Applicant: Ford Global Technologies, LLC, Dearborn, MI (US)

(72) Inventors: Joseph Norman Ulrey, Dearborn, MI (US); Thomas G. Leone, Ypsilanti, MI (US); Mark Allen Dearth, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 227 days.

This patent is subject to a terminal disclaimer.

(21) Appl. No.: 13/919,935

(22) Filed: Jun. 17, 2013

(65) Prior Publication Data

US 2014/0366508 A1 Dec. 18, 2014

(51) Int. Cl.

| | |
|---|---|
| ***F01N 3/04*** | (2006.01) |
| ***F02D 41/00*** | (2006.01) |
| ***F02D 41/02*** | (2006.01) |
| ***F02D 41/12*** | (2006.01) |

(52) U.S. Cl.

CPC ..... *F01N 3/04* (2013.01); *F02D 41/0087* (2013.01); *F02D 41/0275* (2013.01); *F02D 41/123* (2013.01); *F01N 2430/02* (2013.01); *F02D 2041/0265* (2013.01)

(58) Field of Classification Search

CPC ... F01N 3/04; F02D 41/0087; F02D 41/0275; F02D 41/123

See application file for complete search history.

(56) References Cited

U.S. PATENT DOCUMENTS

| | | | | |
|---|---|---|---|---|
| 5,979,413 | A * | 11/1999 | Ohnuma et al. | 123/491 |
| 6,969,492 | B1 | 11/2005 | Goerigk et al. | |
| 7,877,189 | B2 * | 1/2011 | Leone | 701/103 |
| 2007/0191183 | A1 * | 8/2007 | Petridis et al. | 477/109 |
| 2008/0295493 | A1 * | 12/2008 | Applegate et al. | 60/286 |

FOREIGN PATENT DOCUMENTS

WO 2009080152 A1 7/2009

OTHER PUBLICATIONS

Theis, Joseph Norman et al., "NOx Control During Engine Idle-Stop Operations," U.S. Appl. No. 13/565,454, filed Aug. 2, 2012, 62 pages.
Kerns, James Michael et al., "NOx Control During Cylinder Deactivation," U.S. Appl. No. 13/565,490, filed Aug. 2, 2012, 62 pages.
Leone, Thomas G. et al., "Engine Control Catalyst Regeneration," U.S. Appl. No. 13/868,742, filed Apr. 23, 2012, 50 pages.

* cited by examiner

*Primary Examiner* — Audrey K Bradley
*Assistant Examiner* — Brandon Lee
(74) *Attorney, Agent, or Firm* — Julia Voutyras; Alleman Hall McCoy Russell & Tuttle LLP

(57) ABSTRACT

Methods and systems are provided for injecting water based on duration of cylinder deactivation, and exhaust catalyst temperature during an engine cylinder deactivation event so as to reduce an exhaust catalyst regeneration requirement following the cylinder deactivation, and to prevent catalyst degradation.

18 Claims, 7 Drawing Sheets

WATER INJECTION FOR CATALYST OXYGEN REDUCTION AND TEMPERATURE CONTROL DURING TRANSIENT EVENTS

TECHNICAL FIELD

This application relates to catalyst regeneration and catalyst temperature control using water injection during lean events.

BACKGROUND/SUMMARY

Engine emission control systems may include one or more exhaust catalysts to address the various exhaust components. These may include, for example, three-way catalysts, NOx storage catalysts, light-off catalysts, SCR catalysts, etc. Engine exhaust catalysts may utilize periodic regeneration to restore catalytic activity and reduce catalyst oxidation. For example, catalysts may be regenerated by injecting sufficient fuel to produce a rich environment and reduce the amount of oxygen stored at the catalyst. Because fuel consumed during catalyst regeneration can degrade engine fuel economy, various catalyst regeneration strategies have been developed.

One example approach is shown by Georigk et al. in U.S. Pat. No. 6,969,492. Therein, an emission control device includes catalytic converter stages generated by at least two catalysts arranged in series. Specifically, the catalytic stages include a three-way catalyst arranged in series with (e.g., upstream of) a NOx reduction catalyst. The different ammonia storage performance of the different catalysts enables NOx reduction to be improved and reduces the need for catalyst regeneration. Another example approach is shown by Eckhoff et al. in WO 2009/080152. Therein, an engine exhaust system includes multiple NOx storage catalysts with an intermediate SCR catalyst, and an exhaust air-to-fuel ratio is continually alternated between rich and lean phases based on differences between an air-to-fuel ratio upstream of a first NOx storage catalyst and an air-to-fuel ratio downstream of a second NOx storage catalyst.

However, the inventors herein have identified potential issues with such approaches. For example, the inventors have recognized that the regeneration control may degrade during operations when one or more cylinders may be deactivated by shutting off fuel to the cylinders during a vehicle drive cycle. During these operations, while the engine is deactivated and fuel is shut-off to improve drivability and performance, the engine may continue to spin. This spinning pumps air over an exhaust three-way catalyst, causing the catalyst to become oxidized and degrading its ability to reduce NOx when the engine is reactivated. And while enrichment can be used to quickly regenerate the three-way catalyst upon engine reactivation, the enrichment leads to a fuel penalty. Another consequence of engine pumping air over the catalyst may include an increase in catalyst temperature, which further degrades catalyst performance.

In one example, a method may include selectively deactivating one or more engine cylinders via deactivatable fuel injectors during a selected condition; and during the cylinder deactivation, injecting water at the one or more deactivated engine cylinders to reduce oxygenation of a first exhaust catalyst.

Events during which one or more cylinders may be deactivated may include transmission shifting during automatic and manual operations, deceleration fuel shut-off (DFSO), misfire failure mode effects management (misfire FMEM), and engine speed flare control during start-stop transients, for example. In this way, by injecting water and reducing catalyst oxidation during a cylinder deactivation event, a fuel penalty from enrichment during cylinder reactivation may be reduced while maintaining a required NOx emission level. Additionally, water injection during a cylinder deactivation event may reduce excessive increase in catalyst temperature. By reducing catalyst temperature, optimal catalyst performance may be achieved. Further, injecting water at the deactivated cylinders facilitates reduction in the amount of hydrocarbons in the exhaust through a steam reforming process across the first exhaust catalyst, upon fuel reactivation. Therefore, water injection, in addition to reducing oxidation and temperature of the exhaust catalyst, can decrease hydrocarbon emissions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for injecting water during an engine cylinder deactivation event so as to reduce an exhaust catalyst regeneration requirement and to control excessive increase in exhaust catalyst temperature following the cylinder deactivation. The cylinder deactivation event (or lean operation) may include operations such as transmission shift, deceleration fuel shut-off (DFSO), cylinder misfire failure mode effects management (misfire FMEM), and engine speed flare control during start-stop operations in engine system shown at FIGS. 1, 2, and 3. An engine controller may be configured to perform a control routine, such as the example routine of FIG. 4, for injecting water and adjusting exhaust catalyst regeneration. Specifically, water may be injected at one or more deactivated engine cylinders during the cylinder deactivation event based on duration of engine cylinder deactivation and exhaust catalyst temperature. A method for determining the amount of water injection, as well as the timing of the water injection, is presented at FIG. 5. Upon reactivation of the engine cylinders, the engine controller may adjust a combustion air-to-fuel ratio of the reactivated cylinders. Example adjustments to water injection and air-to-fuel ratio in response to cylinder deactivation and exhaust catalyst temperature are shown at FIG. 6. A degree of richness (e.g., amount of rich bias) of the combustion air-to-fuel ratio may be based on an amount of ammonia stored in an exhaust catalyst, such as an SCR catalyst. In this way, an exhaust catalyst, such as a three-way catalyst may be regenerated while reducing the fuel penalty to the engine. Further, by performing water injection, exhaust catalyst temperature may be controlled, thereby preventing exhaust catalyst degradation.

Figure 1:
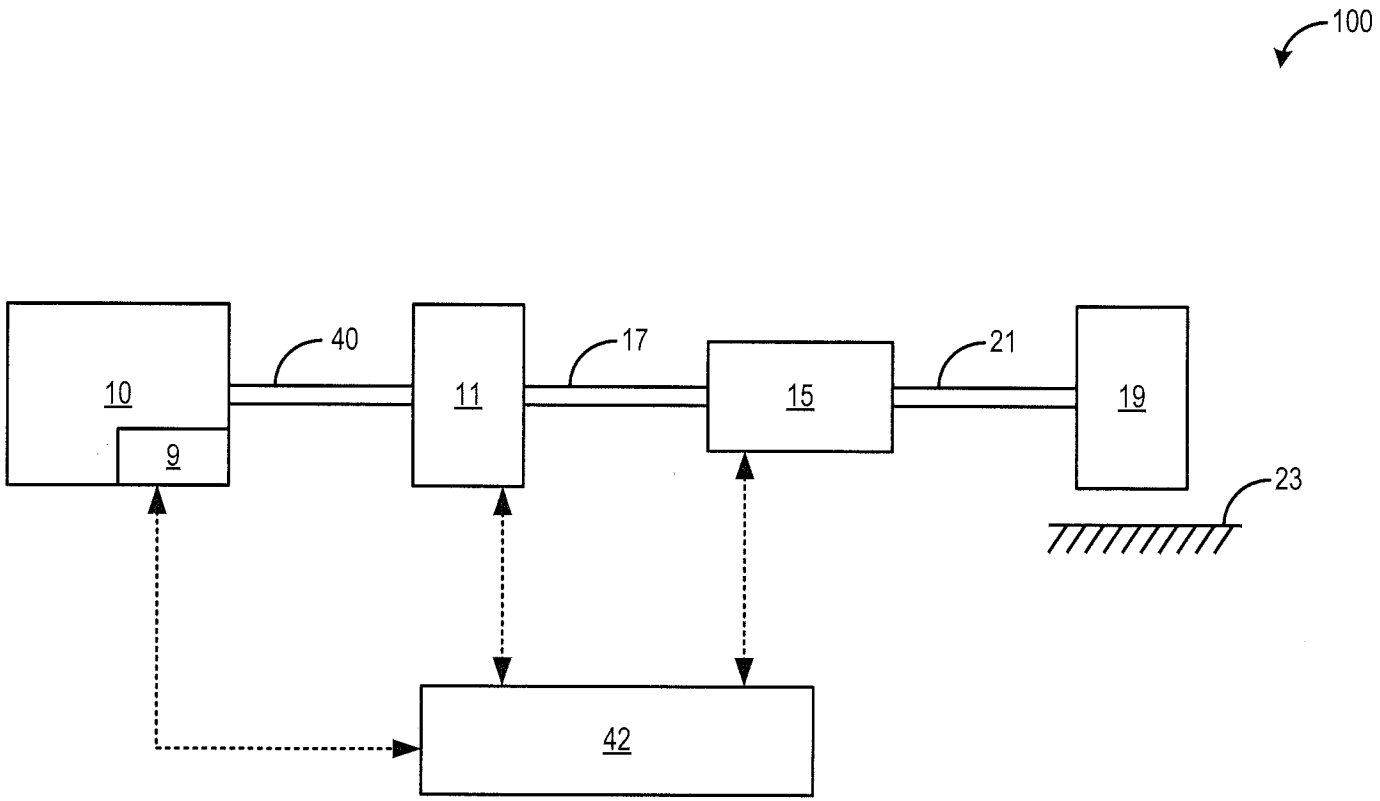
FIG. 1 shows an example vehicle drivetrain.

Referring to FIG. 1, a vehicle drivetrain 100 is shown. The drivetrain includes an internal combustion engine 10. In the depicted example, engine 10 may be selectively deactivated in response to transmission shift, DFSO, cylinder misfire, and start-stop operations as further described herein with particular reference to FIGS. 2-5. Engine 10 is shown coupled to torque converter 11 via crankshaft 40. Engine 10 may include a starter system 9 for assisting in engine cranking at engine restarts. Torque converter 11 is also coupled to transmission 15 via turbine shaft 17. In one example, transmission 15 is a stepped-gear ratio transmission. Transmission 15 may further include various gears and transmission clutches to adjust a torque output from the transmission to wheels 19. Torque converter 11 has a bypass clutch (not shown) which can be engaged, disengaged, or partially engaged. When the clutch is either disengaged or being disengaged, the torque converter is said to be in an unlocked state. Turbine shaft 17 is also known as transmission input shaft. In one embodiment, transmission 15 comprises an electronically controlled transmission with a plurality of selectable discrete gear ratios. Transmission 15 may also comprise various other gears, such as, for example, a final drive ratio (not shown). Alternatively, transmission 15 may be a continuously variable transmission (CVT). In another embodiment, transmission 15 may be a manual transmission, in which case, the drivetrain may comprise of a clutch (instead of torque converter as in an automatic transmission) coupling the engine to the transmission. Transmission shift in a manual transmission may be controlled by a vehicle operator by disengaging and engaging the clutch via a clutch pedal to change gears.

Transmission 15 may further be coupled to wheel 19 via axle 21. Wheel 19 interfaces the vehicle (not shown) to the road 23. Note that in one example embodiment, this powertrain is coupled in a passenger vehicle that travels on the road. While various vehicle configurations may be used, in one example, the engine is the sole motive power source, and thus the vehicle is not a hybrid-electric, hybrid-plug-in, etc. In other embodiments, the method may be incorporated into a hybrid vehicle.

An engine controller 42 may be configured to receive inputs from engine 10 and accordingly control a torque output of the engine and/or operation of torque converter 11, transmission 15, and related clutches. As one example, a torque output may be controlled by adjusting a combination of spark timing, fuel pulse width, fuel pulse timing, and/or air charge, by controlling throttle opening and/or valve timing, valve lift and boost for turbocharged engines. In the case of a diesel engine, controller 42 may also control the engine torque output by controlling a combination of fuel pulse width, fuel pulse timing, and air charge. In all cases, engine control may be performed on a cylinder-by-cylinder basis to control the engine torque output.

When cylinder deactivation conditions are satisfied, controller 42 may selectively deactivate one or more cylinders by turning off fuel injection and spark ignition to the engine cylinders. The deactivated cylinders may be maintained in a deactivated state until cylinder reactivation conditions are confirmed. As such, while the cylinders are spinning (unfueled), air may be pumped through the exhaust catalysts. This air can oxidize the catalysts, in particular, a close-coupled three-way exhaust catalyst, lowering its ability to reduce exhaust NOx species, and degrading exhaust emissions.

Figure 4A:
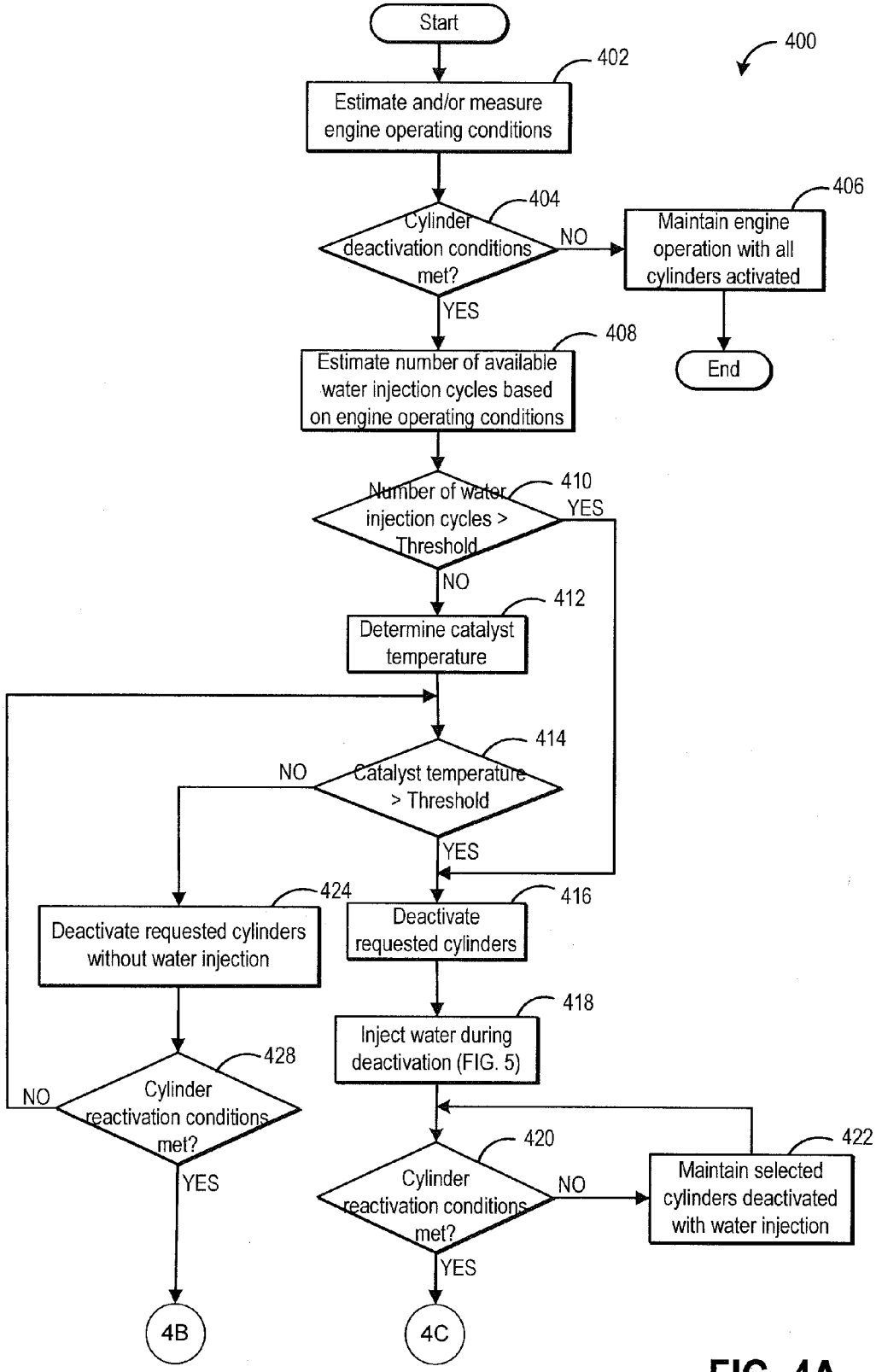
FIGS. 4A, 4B, and 4C show example methods for injecting water and adjusting exhaust catalyst regeneration based on engine cylinder deactivation and exhaust catalyst temperature.
Figure 4B:
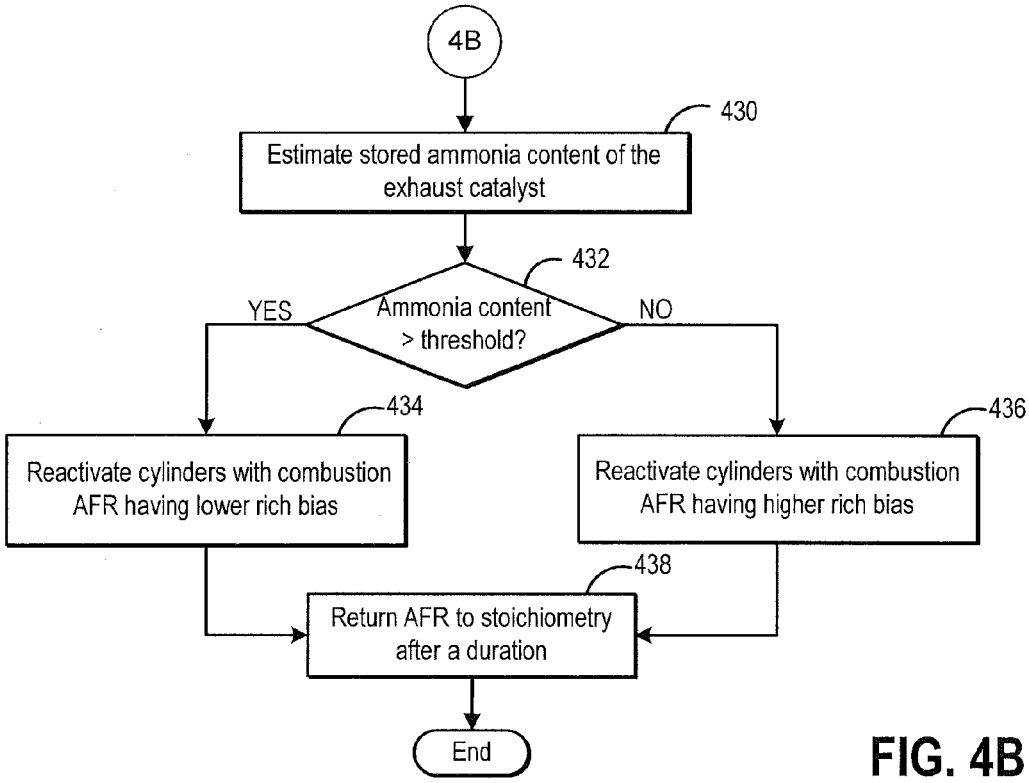
Figure 4C:
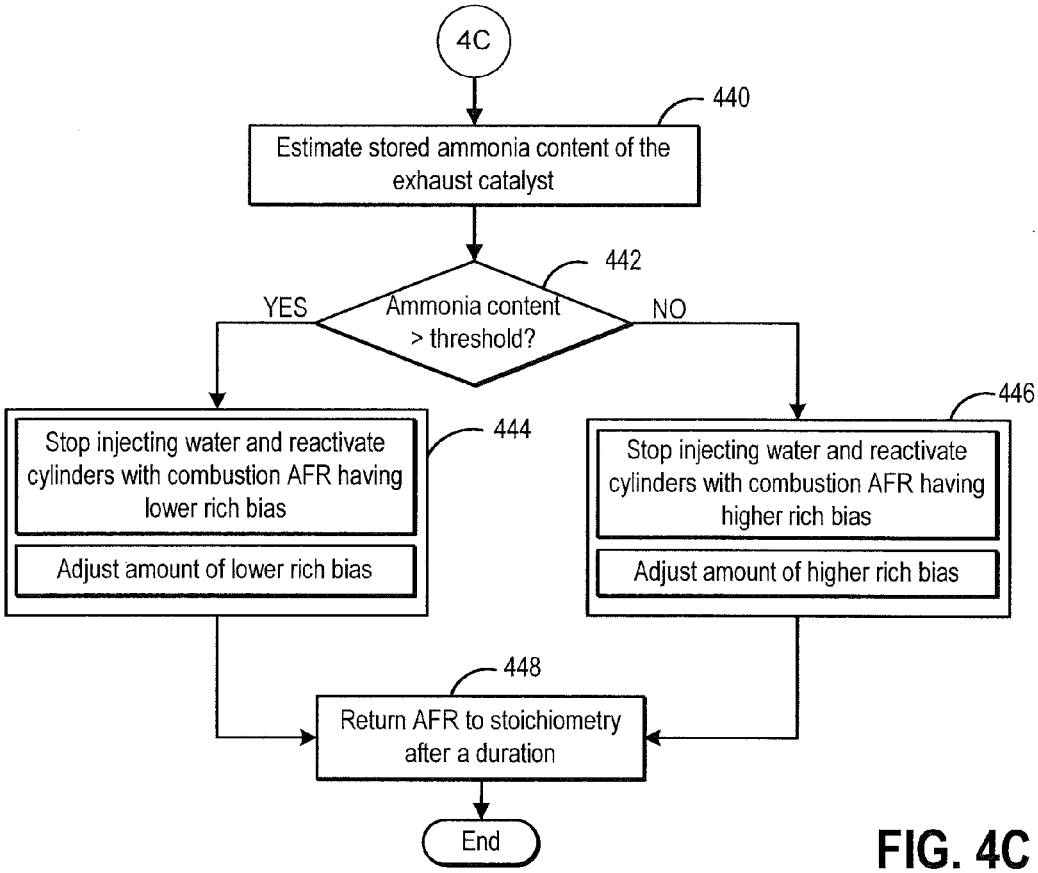
Figure 5:
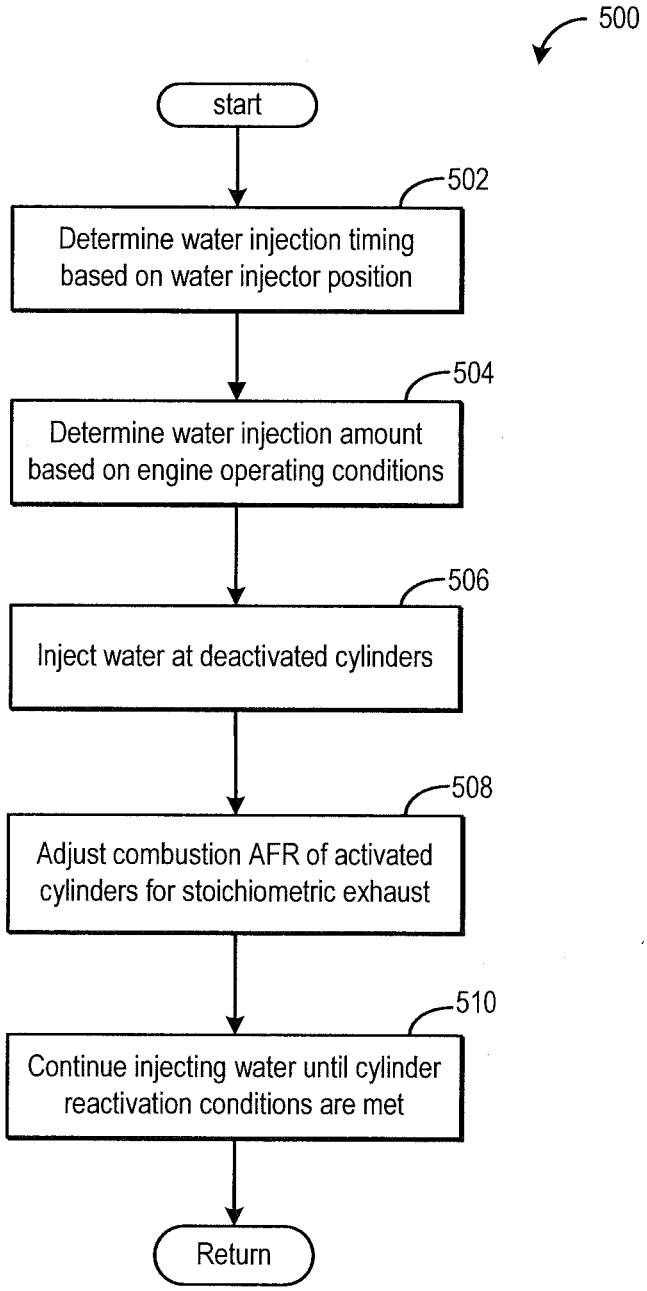
FIG. 5 shows an example method for adjusting water injection during engine cylinder deactivation.
Figure 6:
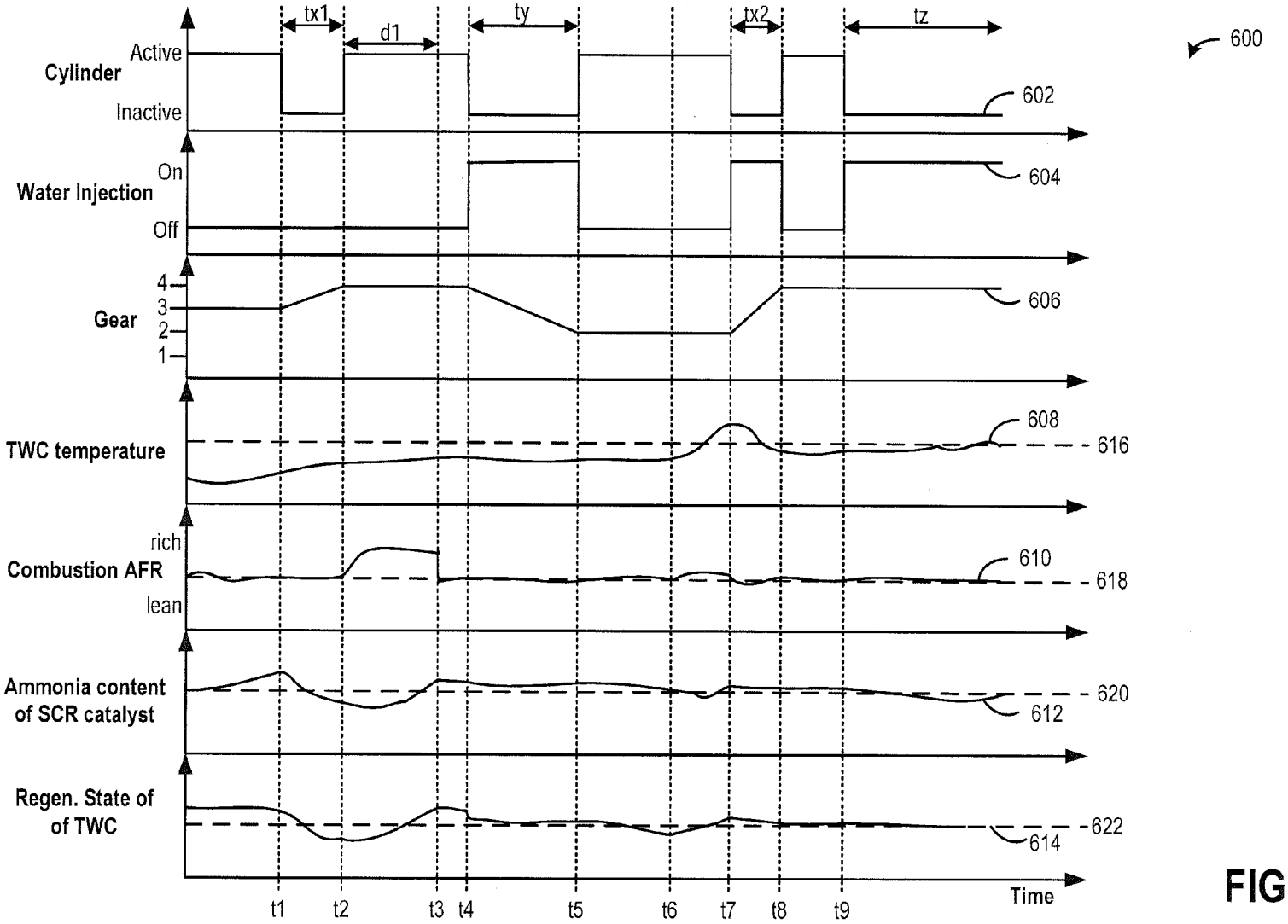
FIG. 6 shows an example of adjusting water injection and combustion air-to-fuel ratio responsive to selective cylinder deactivation and exhaust catalyst temperature.

As elaborated at FIGS. 4-6, the engine controller may also be configured with computer readable instructions for injecting water at the engine cylinders during the deactivation. The water and/or water vapor may then displace air from the engine cylinders, thereby reducing ingestion of air at the deactivated cylinders. This may reduce the amount of air traveling to the catalysts and thus reduce oxidation of the catalysts. Then, following cylinder reactivation, the exhaust catalyst, such as the three-way catalyst, may be regenerated by adjusting the combustion air-to-fuel ratio of the cylinders. Specifically, the combustion air-to-fuel ratio may be decreased such that the air-to-fuel ratio has a rich bias. The amount of rich bias may be based on the ammonia content stored on an exhaust catalyst, such as an SCR catalyst. For example, if the ammonia content of the exhaust catalyst is higher, the rich bias may be lower. Injecting water during cylinder deactivation may allow the ammonia content of the exhaust catalyst to remain at higher level than if water injection was not used. As such, less rich bias may be needed during the cylinder reactivation. This may reduce the fuel penalty incurred in the regeneration of the exhaust catalysts, thereby improving overall fuel economy while meeting NOx emissions requirements. Further, water injection at the deactivated cylinders may reduce hydrocarbon emissions through a steam reforming process across the exhaust catalyst upon fuel reactivation with a rich air-fuel ratio, wherein hydrocarbons in the exhaust may be converted to CO and associated hydrogen may be converted to $H_2$. The CO and $H_2$ may be subsequently oxidized at across the SCR catalyst, thereby reducing hydrocarbon emissions. Additionally, due to endothermic nature of the steam reforming process, injecting water at the deactivated cylinders may reduce increase in exhaust catalyst temperature, thereby preventing exhaust catalyst degradation.

In one example, the SCR catalyst may include copper. In another example, the SCR catalyst may be a copper/zeolite or a modified copper/zeolite SCR catalyst.

Figure 2:
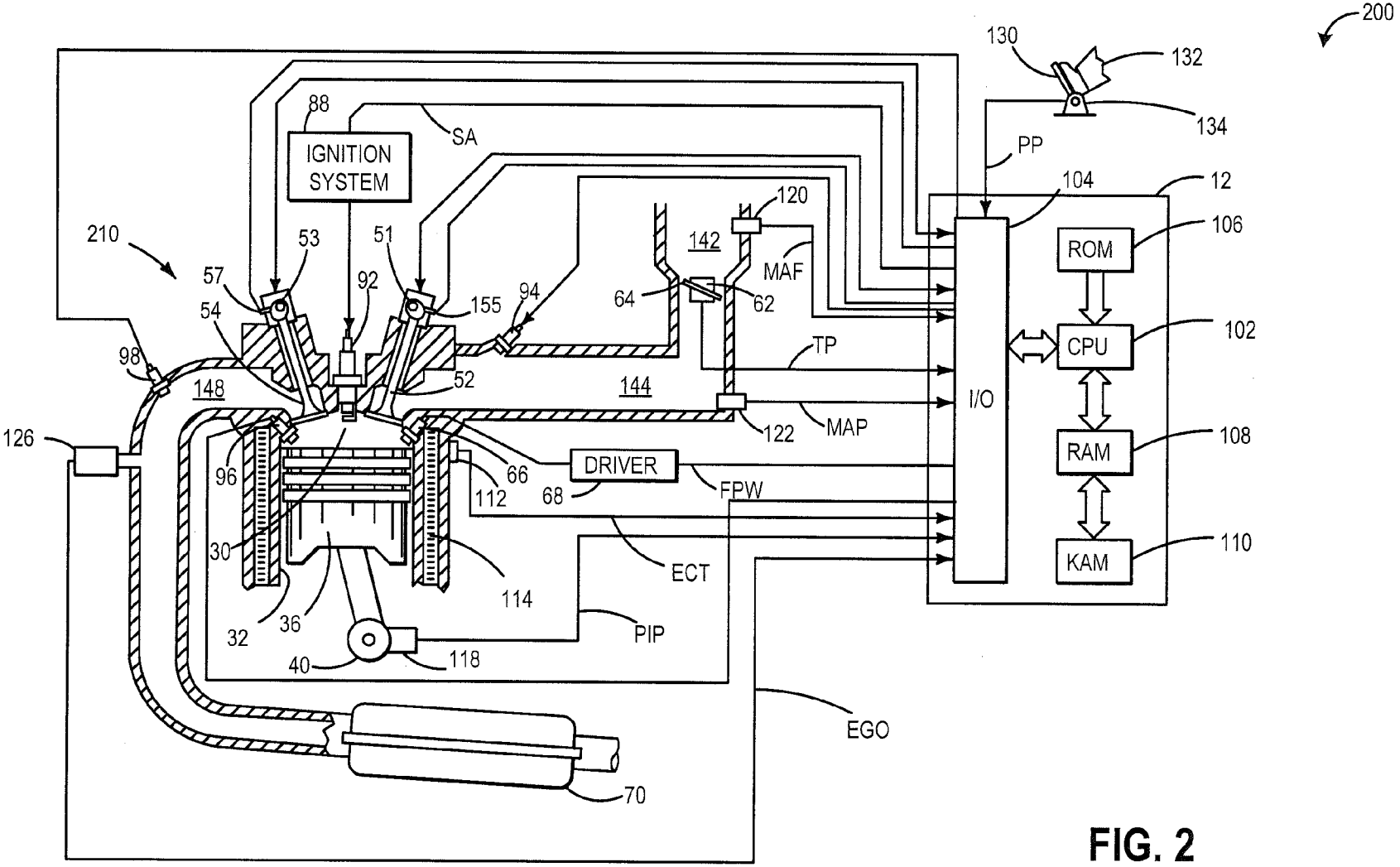
FIG. 2 depicts a partial view of an internal combustion engine.

FIG. 2 is a schematic diagram 200 showing one cylinder of multi-cylinder engine 210, which may be included in a propulsion system of an automobile. Engine 210 may be controlled at least partially by a control system including controller 12 and by input from a vehicle operator 132 via an input device. In one example, the input device includes an accelerator pedal 130 and a pedal position sensor 134 for generating a proportional pedal position signal PP.

Combustion chamber 30 of engine 210 may include cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 210.

Combustion chamber 30 may receive intake air from intake manifold 144 via intake passage 142 and may exhaust combustion gases via exhaust passage 148. Intake manifold 144 and exhaust passage 148 can selectively communicate with combustion chamber 30 via respective intake valve 52 and exhaust valve 54. In some embodiments, combustion chamber 30 may include two or more intake valves and/or two or more exhaust valves. Exhaust camshaft 53 operates exhaust valve 54 in accordance with the profile of a cam located along the length of the exhaust camshaft. Intake camshaft 51 operates intake valve 52 in accordance with the profile of a cam located along the length of the camshaft. Exhaust cam position sensor 57 and intake cam position sensor 155 relay respective camshaft positions to controller 12.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 144 in a configuration that provides what is known as port injection of fuel into the intake port upstream of combustion chamber 30. Intake passage 142 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 142 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Engine 210 may include a water injection system to inject water at deactivated cylinders. The water injection system may include a water injector for each cylinder for injecting water or windshield wiper fluid. In one example, a port water injector 94 may be positioned within the intake manifold 144 at an intake port and/or near the intake valve 52. In another example, a direct water injector (not shown) may be positioned within the combustion chamber 30. In this example, the direct water injector may inject water directly into the engine cylinder. In yet another example, a second port water injector (not shown) may be positioned within the exhaust passage 148, downstream from the exhaust valve 54.

Injecting water at the deactivated engine cylinders may decrease the amount of air traveling through the cylinders, to the exhaust manifold, and to the exhaust catalysts. For example, if the water injection system used in engine 210 is the port water injection system 94, a port water injector may inject water at the intake port, on the intake valve of the deactivated cylinder. In one example, water injection via the port water injection may occur during the cylinder deactivation, before the intake valve opens (e.g., while the intake valve is closed). The injected water may vaporize on and/or around the intake valve. The injected water and/or water vapor may then displace intake air surrounding the intake port. Thus, when the intake valve opens, the water and/or water vapor may displace the intake air, thereby reducing the amount of intake air entering the cylinder. As such, when the exhaust valve of the non-firing (e.g., deactivated) cylinder opens, the water vapor may travel through the exhaust system and to the exhaust catalysts. Any air that passes through the exhaust system may be diluted by the water. Further, oxygen passing through the exhaust system may be reduced having been displaced by water vapor, thereby reducing the oxidation of the exhaust catalysts.

An engine controller may actuate the water injectors of the corresponding deactivated cylinders to inject water during the cylinder deactivation. The controller may control the timing, duration, and amount of water injection. In response to the deactivation of one or more engine cylinders, the controller may actuate water injectors to inject an amount of water into one of the intake port, the engine cylinder, or the exhaust manifold. In one embodiment, the controller may actuate port water injectors to inject water before the intake valve opens. In another embodiment, the controller may actuate direct water injectors to inject water just before the intake valve opens, near top dead center in the combustion stroke. However, in this embodiment the water may not have enough time to expand and displace the air. Thus, by injecting the water near top dead center in the combustion stroke, the heat in the combustion chamber may better vaporize the injected water. In yet another embodiment, the controller may actuate port water injectors in the exhaust manifolds to inject water into the exhaust manifold corresponding to the deactivated cylinder bank before the exhaust valve opens. The controller may then stop water injection when cylinder reactivation conditions are met.

The controller may further control the amount of water injected at one time into the deactivated cylinders. As discussed further below at FIG. 5, the amount of water injected may be based on a volume of the engine cylinder. Specifically, the amount of water injected at the intake port or directly into the engine cylinder may correspond to the amount of water that may substantially fill the cylinder with water vapor. As such, this amount of water vapor may reduce the available space for air to enter the cylinder and reach the exhaust system and exhaust catalysts. A volume of water vapor formed by an amount of injected water may increase with increasing temperature. Thus, the amount of water injected at the deactivated cylinders may be based on an engine cylinder volume and intake port and/or manifold temperature. The amount of water injected may be further based on additional engine operating conditions such as manifold pressure, MAP, estimated piston valve and head temperatures, and/or engine speed. Still further, the amount of water injected may be based on an indication from an exhaust gas oxygen sensor.

In this way, injecting water at the deactivated cylinders may reduce air entering the combustion chamber and subsequently, the exhaust pipe, which will reduce the oxygen concentration reaching the exhaust catalyst, thereby reducing the amount of catalyst reduction and the amount of catalyst regeneration required after reactivating the cylinders. Injected water may act to displace intake air and reduce the amount of oxygen flowing through the deactivated cylinders and into the exhaust manifold. Further, water and/or water vapor traveling through the exhaust system may react with hydrocarbons across the first exhaust catalyst to form CO and $H_2$ in a steam forming reaction. The $H_2$ may then reduce NO across the catalyst to form ammonia, $NH_3$. Further, it is noted that the CO and $H_2$ formed does not strongly react with ammonia in a second exhaust catalyst (such as, SCR catalyst) and may be oxidized by residual $O_2$ across the second exhaust catalyst. After the engine cylinders are reactivated, the engine controller may then adjust a combustion air-to-fuel ratio during the cylinder reactivation based on an amount of ammonia stored on the SCR catalyst at the time of reactivation. In one example, the cylinders may be reactivated with a combustion air-to-fuel ratio that is richer than stoichiometry. If the amount of ammonia in the SCR catalyst is below a threshold level at cylinder reactivation, the richer combustion air-to-fuel ratio may have a higher rich bias. However, if the amount of ammonia in the SCR catalyst is greater than the threshold level at cylinder reactivation, the richer combustion air-to-fuel ratio may have a lower rich bias. The rich air-to-fuel ratio may be combusted for a duration in order to regenerate the three-way catalyst (e.g., the close-coupled catalyst). In this way, the regeneration requirements for the close-coupled catalyst may be reduced depending on how much ammonia is stored in the SCR catalyst.

By injecting water at the deactivated engine cylinders during cylinder deactivation, less oxygen may enter the exhaust system, thereby reducing oxidation of a first exhaust catalyst (e.g., a three-way catalyst). Further, upon water injection at the deactivated cylinders, due to steam reforming across the first exhaust catalyst, and subsequent oxidation of $H_2$ and CO across a second exhaust catalyst (e.g., SCR catalyst), hydrocarbon emissions may be reduced. Consequently, increase in exhaust catalyst temperature may be reduced. Additionally, water may increase ammonia formation at a second exhaust catalyst (e.g., SCR catalyst), thereby increasing the amount of ammonia available during cylinder reactivation. As such, injecting water may reduce the amount of rich bias required after reactivating the engine cylinders, thereby reducing the fuel penalty incurred during regeneration of the first catalyst.

Note that there are various conditions during which one or more cylinders may be deactivated. In some cases, less than all of the engine cylinders may be deactivated (e.g., fuel injection deactivated) during an engine cycle, and only for a single engine cycle. In an embodiment, during engine starting, a number of sequentially firing cylinders may be deactivated in a single engine cycle (e.g., only two sequential cylinders of six total cylinders, or only three sequential cylinders of six total cylinders). The number of cylinders deactivated in the single engine cycle may be based on a torque reduction request to reduce engine speed flare during an engine re-start of an idle stop, thereby reducing torque transmitted through an at least partially engaged transmission, such as one with a torque converter. In this circumstance, water injection as described herein may be applied to those deactivated cylinders.

In an embodiment, fuel injector deactivation during transmission shifting events may be used to control engine torque and improve shift quality. Again, a select number of specific cylinder fueling events may be skipped to rapidly reduce torque for a short duration (e.g., a single cylinder combustion event in an engine cycle). In this circumstance, water injection as described herein may be applied to each of the deactivated cylinders.

Still other embodiments may utilize the water injection as described further herein, such as other transmission events, engine starting operation, default operation in response to component degradation, and others.

Returning to FIG. 1, exhaust gas sensor 126 is shown coupled to exhaust passage 148 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 148 downstream of exhaust gas sensor 126. Device 70 may be a three way catalyst (TWC), NOx trap, SCR catalyst, various other emission control devices, or combinations thereof. For example, an emission control system of a vehicle may include one or more emission control devices with at least one SCR catalyst and at least one three-way catalyst. These catalysts may be arranged into different configuration within the emission control system. As such, the methods described further below may be implemented in a variety of engines with different emission control system configurations. In one example, emission control device 70 may comprise of a first exhaust catalyst (such as a three way catalyst), and a second exhaust catalyst (such as an SCR catalyst). Further, the emission control device 70 may comprise a temperature sensor (not shown) to provide an indication of temperature of the first exhaust catalyst (that is, the three way catalyst).

Controller 12 is shown in FIG. 2 as a microcomputer, including microprocessor unit 102, input/output ports 104, an electronic storage medium for executable programs and calibration values shown as read-only memory 106 in this particular example, random access memory 108, keep alive memory 110, and a data bus. Controller 12 may receive various signals from sensors coupled to engine 210, in addition to those signals previously discussed, including measurement of inducted mass air flow (MAF) from mass air flow sensor 120; engine coolant temperature (ECT) from temperature sensor 112 coupled to cooling sleeve 114; vehicle brake; a profile ignition pickup signal (PIP) from Hall effect sensor 118 (or other type) coupled to crankshaft 40; throttle position (TP) from a throttle position sensor; exhaust catalyst temperature from an exhaust catalyst temperature sensor (not shown); and absolute manifold pressure signal, MAP, from manifold pressure sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. In one example, sensor 118, which is also used as an engine speed sensor, may produce a predetermined number of equally spaced pulses every revolution of the crankshaft.

Storage medium read-only memory 106 can be programmed with computer readable data representing instructions executable by microprocessor unit 102 for performing the methods described below as well as other variants that are anticipated but not specifically listed.

Controller 12 also receives signals from and provides control signals to a transmission (not shown). Transmission signals may include but are not limited to transmission input and output speeds, signals for regulating transmission line pressure (e.g., fluid pressure supplied to transmission clutches), and signals for controlling pressure supplied to clutches for actuating transmission gears.

As described above, FIG. 2 shows only one cylinder of a multi-cylinder engine, and that each cylinder may similarly include its own set of intake/exhaust valves, fuel injector, spark plug, etc.

Figure 3:
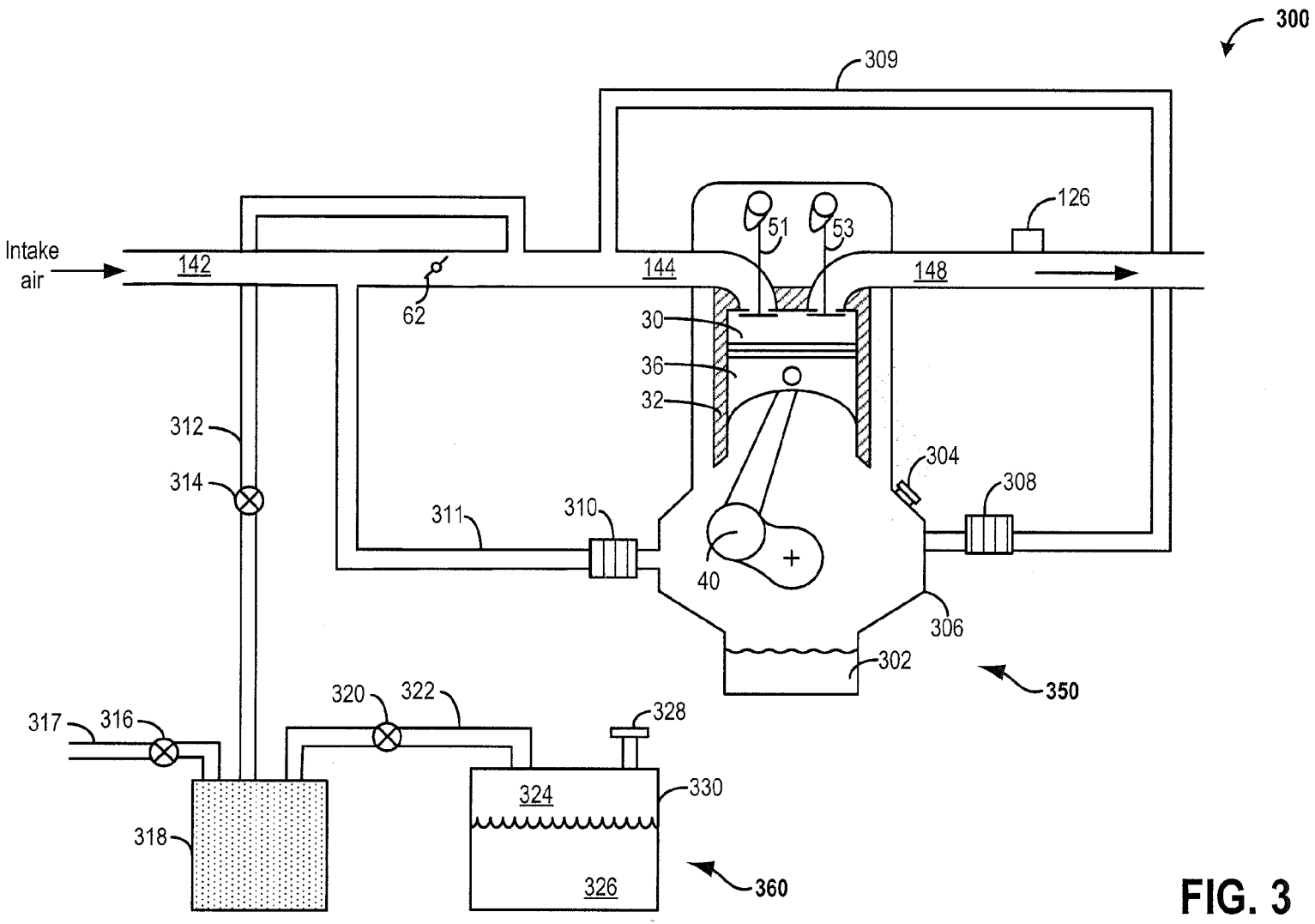
FIG. 3 shows a schematic depiction of a positive crankcase ventilation system and a fuel tank purge system coupled to an engine system.

Turning to FIG. 3, it shows an engine system 300, such as the engine system described at FIG. 2, comprising positive crankcase ventilation (PCV) system 350, and fuel tank purge system 360.

PCV system 350 may include a crankcase 306 encasing a crankshaft 40 with oil well 302 positioned below the crankshaft. An oil fill port 304 may be disposed in crankcase 306 so that oil may be supplied to oil well 302.

The engine system 300 may further include a combustion chamber 30. The combustion chamber 30 may include combustion chamber walls 32 with piston 36 positioned therein. Piston 36 may be coupled to crankshaft 40 so that reciprocating motion of the piston is translated into rotational motion of the crankshaft. Combustion chamber 30 may receive intake air from intake manifold 144 which is positioned downstream of throttle 62.

A throttle 62 may be disposed in the engine intake to control the airflow entering intake manifold 144. The intake air may enter combustion chamber 30 via cam-actuated intake valve system 51. Likewise, combusted exhaust gas may exit combustion chamber 30 via cam-actuated exhaust valve system 53. In an alternate embodiment, one or more of the intake valve system and the exhaust valve system may be electrically actuated.

Exhaust combustion gases exit the combustion chamber 30 via exhaust passage 148. An exhaust gas sensor 126 may be disposed along exhaust passage 148. Sensor 64 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 126 may be connected with controller 12.

In the example of FIG. 3, PCV system 350 is coupled to the engine intake so that gases in the crankcase may be vented in a controlled manner from the crankcase. During conditions when manifold pressure (MAP) is less than barometric pressure (BP), the crankcase ventilation system 350 draws air into crankcase 306 via a breather or vent tube 311. Crankcase ventilation tube 311 may be coupled to fresh air intake passage 142 upstream of the throttle 62.

PCV system 350 also vents gases out of the crankcase and into intake manifold 42 via a conduit 309 (herein also referred to as PCV line 309). It will be appreciated that, as used herein, PCV flow refers to the flow of gases through conduit 309 from the crankcase to the intake manifold. Similarly, as used herein, PCV backflow refers to the flow of gases through conduit 309 from the intake manifold to the crankcase. PCV backflow may occur when intake manifold pressure is higher than crankcase pressure. In some examples, PCV system 350 may be equipped with means for preventing PCV backflow. In other examples, the occurrence of PCV backflow may be inconsequential, or even desirable; in these examples, PCV system 350 may exclude means for preventing PCV backflow, or may advantageously use PCV backflow for vacuum generation, for example.

The gases in crankcase 306 may consist of un-burnt fuel, un-combusted air, and fully or partially combusted gases. Further, lubricant mist may also be present. As such, various oil separators may be incorporated in crankcase ventilation system 350 to reduce exiting of the oil mist from the crankcase through the PCV system. For example, PCV line 309 may include a uni-directional oil separator 308 which filters oil from vapors exiting crankcase 306 before they re-enter the intake manifold 144. Another oil separator 310 may be disposed in conduit 311 to remove oil from the stream of gases exiting the crankcases during boosted operation. Additionally, PCV line 309 may also include a vacuum sensor (not shown) coupled to the PCV system.

Fuel system 360 includes a fuel tank 330 coupled to a fuel pump (not shown) and a fuel vapor canister 318. During a fuel tank refueling event, fuel may be pumped into the vehicle from an external source through refueling door 328. Fuel tank 330 may hold a plurality of fuel blends, including fuel with a range of alcohol concentrations, such as various gasoline-ethanol blends, including E10, E85, gasoline, etc., and combinations thereof. A fuel level sensor (not shown) located in fuel tank 330 may provide an indication of the fuel level ("Fuel Level Input") to controller 12. It will be appreciated that fuel system 360 may be a return-less fuel system, a return fuel system, or various other types of fuel system. Vapors generated in fuel tank 20 may be routed to fuel vapor canister 318, via conduit 322, before being purged to the engine intake 144.

Fuel vapor canister 318 may be filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 318 may be purged to engine intake 144 by opening canister purge valve 314. While a single canister 318 is shown, it will be appreciated that fuel system 360 may include any number of canisters. In one example, canister purge valve 314 may be a solenoid valve wherein opening or closing of the valve is performed via actuation of a canister purge solenoid.

Canister 318 includes a vent 317 for routing gases out of the canister 318 to the atmosphere when storing, or trapping, fuel vapors from fuel tank 330. Vent 317 may also allow fresh air to be drawn into fuel vapor canister 318 when purging stored fuel vapors to engine intake 144 via purge line 312 and purge valve 314. While this example shows vent 317 communicating with fresh, unheated air, various modifications may also be used. Vent 317 may include a canister vent valve 316 to adjust a flow of air and vapors between canister 318 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 316 may be a solenoid valve wherein opening or closing of the valve is performed via actuation of a canister vent solenoid. In particular, the canister vent valve may be opened and closed upon actuation of the canister vent solenoid.

Fuel vapors released from canister 318, for example during a purging operation, may be directed into engine intake manifold 144 via purge line 312. The flow of vapors along purge line 312 may be regulated by canister purge valve 314, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 312 to prevent intake manifold pressure from flowing gases in the opposite direction of the purge flow. As such, the check valve may be necessary if the canister purge valve control is not accurately timed or the canister purge valve itself can be forced open by a high intake manifold pressure.

During certain engine operations such as DFSO, when one or more cylinders may be deactivated, vacuum generated in the intake manifold may cause an excess of un-burnt hydrocarbons from the PCV flow system and/or the fuel tank purge system to flow into the deactivated cylinder and subsequently into the exhaust, and the emission control devices. Increased load of un-burnt hydrocarbons may cause an increase in the exhaust catalyst temperature. Performing water injection at the deactivated cylinders during a DFSO event may reduce hydrocarbon emissions and control increase in exhaust catalyst temperatures. Upon water injection, expanding water vapors may reduce an amount of hydrocarbons entering the deactivated cylinders by displacement. In addition, water vapor flowing through the exhaust facilitates a steam reforming process during which, some of the hydrocarbons in the exhaust may be converted to CO and $H_2$ across the first exhaust catalyst. The CO and $H_2$ thus formed may be subsequently consumed by residual oxygen across a second exhaust catalyst, such as an SCR catalyst. Further, due to the steam reforming process being endothermic, exhaust catalyst temperature may be reduced. Therefore, to reduce the unburnt hydrocarbons from the PCV flow and/or evaporative emissions from the fuel tank purge line entering deactivated cylinders and reduce hydrocarbon emissions during a DFSO event, water injection may be performed at the deactivated cylinders. The water injection may include adjusting the amount of water injection in a closed loop manner based on an indication of exhaust gas air composition from the exhaust gas sensor 126. By adjusting the amount of water injection, the amount of air entering the cylinder and the exhaust may be controlled.

In this way, by adjusting the amount of water injection at the deactivated cylinders based on an indication from exhaust gas sensor during DFSO events, the amount of unburned hydrocarbons entering deactivated cylinders may be reduced (as they are displaced by expanding water vapor), such that those hydrocarbons can pass to cylinders without water injection (and in which combustion is carried out and or so that they can later pass to reactivated cylinders without water injection (and in which combustion is carried out). Such operation may be performed even with the throttle at the intake manifold near closed or closed, generating manifold vacuum that would otherwise increase vapors drawn into the manifold and passed through the deactivated cylinders to the exhaust. Further, hydrocarbon emissions and increase in exhaust catalyst temperature may be reduced (by steam reforming process) as discussed above. Details regarding adjusting water injection amount during cylinder deactivation will be further elaborated at FIG. 5.

The systems of FIGS. 1-3 provide for an engine system including an engine which includes an intake manifold and an engine cylinder. The engine cylinder has an intake port with an intake valve and a deactivatable fuel injector. The engine system further includes a water injection system having a water injector positioned in the intake port, upstream of the intake valve, for injecting water on the intake valve, and an emission control device having a first exhaust catalyst and a second exhaust catalyst. The engine system also includes a controller with computer readable instructions for selectively deactivating one or more engine cylinders via deactivatable fuel injectors and injecting water at the one or more deactivated engine cylinders during the deactivation to reduce oxidation of the first exhaust catalyst. After the deactivation, the controller may stop water injection, reactivate the one or more deactivated engine cylinders, and adjust a combustion air-to-fuel ratio of the reactivated engine cylinders based on an ammonia content stored in the second exhaust catalyst.

In this way, one or more engine cylinders may be selectively deactivated via deactivatable fuel injectors. Then, during cylinder deactivation, water may be injected at the one or more deactivated engine cylinders to reduce oxidation of a first exhaust catalyst. In one example, injecting water at the one or more deactivated cylinders may include port injecting water on a closed intake valve of the one or more deactivated engine cylinders before the intake valve opens. In another example, injecting water at the one or more deactivated cylinders may include direct injecting water into the one or more deactivated engine cylinders before an intake valve of the one or more deactivated engine cylinders opens. In yet another example, water may be injected at an exhaust manifold of the one or more deactivated engine cylinders before an exhaust valve of the one or more deactivated engine cylinders opens.

An engine controller may adjust an amount of water injected during the injecting water based on one or more of an engine cylinder volume, engine temperature, engine speed, a manifold pressure, and an exhaust gas oxygen amount. Further, the engine controller may estimate ammonia content stored in a second exhaust catalyst after engine cylinder reactivation conditions are met. Then, in response to the engine cylinder reactivation conditions being met, water injection may be stopped and the one or more deactivated engine cylinders may be reactivated. The method may further include adjusting a combustion air-to-fuel ratio of the reactivated engine cylinders based on the ammonia content stored in the second exhaust catalyst. The combustion air-to-fuel ratio may decrease with decreasing ammonia content.

In one example, selectively deactivating one or more engine cylinders may include deactivating one or more cylinders responsive to a transmission shift in an automatic transmission for transmission torque control. Alternatively, one or more cylinders may be deactivated in response to a transmission shift in a manual transmission. In a second example, selectively deactivating one or more engine cylinders may include deactivating one or more engine cylinders responsive to a deceleration fuel shut-off event. In a third example, selectively deactivating one or more cylinders may include deactivating one or more cylinders in response to cylinder misfire detection. In a fourth example, selectively deactivating one or more cylinders may include deactivating one or more engine cylinders during start-stop transient operations to control engine speed flare. Further, when one or more engine cylinders are deactivated, other engine cylinders may continue combusting. For example, a method for selectively deactivating engine cylinders may include deactivating only some of the engine cylinders while the remaining engine cylinder continue operating by continuing fuel injection and combustion of the remaining active cylinders. Further, various combinations of the above examples may occur together, and further the methods of operation for each of the above examples is usable together, and all may be used together.

Now turning to FIG. 4, method 400 shows an example routine for injecting water based on a duration of engine cylinder deactivation and exhaust catalyst temperature, and adjusting exhaust catalyst regeneration following cylinder deactivation. In particular, the method includes injecting water at deactivated engine cylinders to reduce the oxidation of the exhaust catalyst, and to reduce exhaust catalyst temperature. Then, during subsequent cylinder reactivation, less exhaust catalyst regeneration may be required, and exhaust catalyst degradation may be reduced. In one example, the exhaust catalyst may be a first exhaust catalyst such as a three-way catalyst. Engine cylinder deactivation may occur during operations including each of a transmission shift, DFSO, cylinder misfire FMEM, and start-stop applications, for example, when shutting off fuel may be advantageous. Depending upon the nature of the operation, cylinder deactivation may occur for a relatively short, medium or long duration of time. As one example, engine cylinder deactivation resulting from a transmission shift in an automatic transmission may occur for a shorter duration (that is, fewer engine cycles) than engine cylinder deactivation due to a DFSO event. An engine controller, such as controller 12 discussed at FIG. 1, may include instructions stored thereon for executing method 400.

At 402, the method includes estimating and/or measuring vehicle and engine operating conditions. These may include, for example, MAP, air-to-fuel ratio (AFR), exhaust flow rate, exhaust temperature, vehicle speed, engine speed, state of charge of a system battery, ambient temperature and pressure, engine or manifold temperature, crankshaft speed, transmission speed, fuels available, fuel alcohol content, etc.

At 404, the controller may determine if cylinder deactivation conditions have been met based on the estimated operating conditions. In one example, cylinder deactivation condition may be a transmission shift operation which includes transmission upshift to change from a higher gear ratio to a lower gear ratio. During transmission shifting, one or more engine cylinders may be deactivated to reduce engine torque, and consequently, reduce engine speed to a desired speed for the future gear of the transmission shift. Transmission shift conditions may be determined based on, engine speed, engine torque, vehicle speed, accelerator pedal position, throttle valve position, state of gear change, etc. In some examples, transmission shift conditions may include operations in an automatic transmission. In some other examples, a transmission shift may include operations in a manual transmission.

In a second example, a cylinder deactivation condition may be a deceleration fuel shut-off operation, which may be performed by shutting off fuel to one or more engine cylinders during engine deceleration to improve fuel economy and limit vehicle speed. Deceleration fuel shut-off conditions may be determined based on accelerator pedal position, engine speed, brake application detection, vehicle speed, throttle valve position, etc. In a third example, engine operating conditions may indicate a cylinder misfire identified based on crankshaft speed variation, for example. Misfiring cylinders may be deactivated to prevent fuel that is not combusted from flooding the exhaust catalyst. In a fourth example, cylinder deactivation condition may occur during start-stop transient operations and may be based on engine speed exceeding a flare threshold speed, application/release of brake pedal, etc. One or more cylinders may be deactivated to reduce the initial torque during a start following start-stop events and reduce engine speed surge of the initial run-up.

In an alternate embodiment, it may be determined if a shutdown request has been received from the vehicle operator. In one example, a shutdown request from the vehicle operator may be confirmed in response to a vehicle ignition being moved to a key-off position. If an operator requested shutdown is received, the engine may be similarly deactivated by shutting off fuel and/or spark to the engine cylinders, and the engine may spin down to rest.

If any of the cylinder deactivation conditions are not met at 404, the routine may end with the engine operating with all engine cylinders activated and firing.

However, if any or all of the cylinder deactivation conditions are met, then at 408, the controller may estimate the number of available water injection cycles based on cylinder deactivation conditions. The number of water injection cycles may be based on estimated time duration of cylinder deactivation. For example, if the cylinders are deactivated during a transmission shift operation, the duration in which the cylinders remain deactivated may be less than cylinder deactivation duration during a DFSO operation. Consequently, the number of water injection cycles during a transmission shift event may be less than the number of water injection cycles during a DFSO event.

Upon estimating the number of available water injection cycles, the controller, at 410, may determine if the number of water injection cycles is greater than a threshold. If yes, then at 416, the controller may deactivate the requested cylinders and prepare the deactivated cylinder for water injection. For example, if estimated number of available water injection cycles during a DFSO operation is greater than threshold number of cycles, the controller may execute an automatic DFSO operation, selectively deactivate the engine, and prepare the system for water injection. Engine deactivation may include shutting off fuel injection and/or spark ignition to the engine. For example, selectively deactivatable fuel injectors of selected cylinders may be deactivated and spark ignition to the selected cylinders may be discontinued. Preparing for water injection may include determining water injection timing and water injection amount. Additional details of water injection will be elaborated at FIG. 5.

Next, upon cylinder deactivation, at 418, the method includes injecting water via water injectors at the deactivated cylinders during the cylinder deactivation. This may include injecting water into deactivated cylinders with direct water injection or port injecting water at the intake port and valve or at the exhaust manifold with port water injection. Details on determining the amount of water injected and adjusting water injection during cylinder deactivation are presented at FIG. 5.

Next at 420, the method includes determining if cylinder reactivation conditions have been met. During transmission shifting, cylinder reactivation may be determined based on completion of a transmission upshift (e.g., completion of a gear shift from a higher ratio to a lower ratio). During deceleration fuel shut-off operation, cylinder reactivation condition may be based on brake release, accelerator pedal position, throttle valve position, engine speed, and vehicle speed. Cylinder reactivation conditions for a misfiring cylinder may be based on completion of cylinder repair to rectify the misfire. During start-stop transient operations, cylinder reactivation conditions may be based on release of brake pedal, operator requested torque, engine speed etc.

If cylinder reactivation conditions are not met, then at 422, the engine operation may be maintained with one or more engine cylinders selectively deactivated with water injection.

In comparison, if the cylinder reactivation conditions are met at 420, the method continues on to the method at FIG. 4C to estimate a stored ammonia content of a second exhaust catalyst. In one example, the second exhaust catalyst may be an SCR catalyst. The amount of ammonia stored on the second catalyst may depend on various factors that contribute to ammonia being produced and stored on the catalyst as well as various factors that contribute to ammonia being drawn out (e.g., consumed or dissipated) from the second exhaust catalyst. These include, for example, temperature, flow rate, and air-to-fuel ratio of exhaust flowing through the second catalyst. The ammonia content of the second catalyst may be further based on the type of lean event, the duration of the lean event, the duration since the last lean event, feedgas (FG) NOx mass, and engine operating conditions, such as air-to-fuel ratio, during non-lean events.

Returning to 410, if the number of water injection cycles is not greater than threshold, the routine proceeds to 412 at which, temperature of the exhaust catalyst may be determined. The exhaust catalyst may be a first exhaust catalyst. The first exhaust catalyst may be a three-way catalyst. Next, at 414, it may be determined if the first exhaust catalyst temperature is greater than threshold. If yes, then the controller performs the routine at 416 which includes deactivating the cylinders and preparing for water injection. Under such conditions, where the temperature of the exhaust catalyst is greater than threshold, it may be advantageous to perform cylinder deactivation with water injection in order to reduce the catalyst temperature, and thereby reduce catalyst degradation. However, at 414, if the exhaust catalyst temperature is determined to be less than the threshold temperature, the routine may perform cylinder deactivation at 424 without water injection.

From 424, the routine may proceed to 428 at which it may be determined if cylinder reactivation conditions have been met as described above. If cylinder reactivation conditions have been met, then the controller may perform the method at FIG. 4B.

Continuing on to FIGS. 4B and 4C, at 430, and at 440 respectively, the controller may determine if an estimated ammonia content of the second exhaust catalyst is greater than a threshold level. The threshold level may indicate how much regeneration of the first exhaust catalyst is required. For example, as the ammonia content of the second exhaust catalyst increases, less regeneration of the first exhaust catalyst may be required. Reactivating the engine cylinders may include resuming spark ignition and reactivating the cylinder fuel injectors. Additionally, fueling to the cylinders may be adjusted so that the exhaust air-to-fuel ratio has a higher or lower rich bias, the higher or lower rich bias based on the ammonia content of the second exhaust catalyst in comparison to the threshold level. In one example, a higher or lower rich bias may be adjusted based on amount of water injected during water injection at the deactivated cylinders, to take advantage of increased hydrocarbon reaction via the steam reforming process, as explained above.

As such, if the ammonia content of the second exhaust catalyst is greater than the threshold level at 432 (or at 442 at FIG. 4C), the controller may reactivate the cylinders at 434 (or at 444 at FIG. 4C) with a combustion air-to-fuel ratio having a lower rich bias. In some examples, this may include an air-to-fuel ratio slightly less than the stoichiometric ratio. In other example, this may include an air-to-fuel ratio at stoichiometry. For example, if no regeneration of the first exhaust catalyst is needed, the cylinder may be reactivated and operated at stoichiometry. As such, the amount of lower rich bias may decrease with increasing ammonia content of the second exhaust catalyst and decreasing required regeneration of the first exhaust catalyst. At FIG. 4C, the method at 444 further includes stopping water injection at the cylinders when reactivating the one or more deactivated engine cylinders.

Alternatively, if the ammonia content of the second exhaust catalyst is not greater than the threshold level, the method continues on to 436 (or to 446 at FIG. 4C). At 436 (or at 446 at FIG. 4C) the controller may reactivate the engine cylinders with a combustion air-to-fuel ratio having a higher rich bias. As such, the combustion air-to-fuel ratio used at 436 (or at 446 at FIG. 4C) is richer than the combustion air-to-fuel ratio used at 434 (or at 444 at FIG. 4C). Further, at FIG. 4C, the method at 446 includes stopping water injection when reactivating the deactivated cylinders. In this way, the combustion air-to-fuel ratio of the reactivated cylinders may be richer when the ammonia content of the second exhaust catalyst is lower.

In one example, the adjusting the combustion air-to-fuel ratio of the reactivated engine cylinders may be carried out for a duration, based on the estimated ammonia content of the second exhaust catalyst and the emission control system configuration. As such, after the duration, the combustion air-to-fuel ratio of the reactivated cylinders may return to stoichiometry. For example, as the ammonia content estimated at 430 (or at 440) increases, the duration of combusting the richer air-to-fuel ratio may decrease.

In one example, an amount of rich bias at reactivation may be further adjusted based on an amount of water injected at the deactivated cylinders during the cylinder deactivation. For example, depending on the amount of water injected, more or less hydrocarbons may be converted during the steam reforming process across the first exhaust catalyst during reactivation. Accordingly, the impact of hydrocarbons on the exhaust catalyst may be reduced by appropriately controlling the rich bias upon reactivation. Consequently, the regeneration requirement for the first exhaust catalyst may vary depending upon the amount of water injected. For example, with increasing amount of water injection, the regeneration requirement for the exhaust catalyst may decrease. For example, the duration of the rich bias or the richness of the rich bias may be reduced.

After waiting the determined duration, at 438 (or at 448 at FIG. 4C) the air-fuel-ratio may be returned to stoichiometry. In one example, the combustion air-fuel-ratio of the reactivated cylinders may be increased from the adjusted or richer air-fuel-ratio (with higher or lower rich bias) to the stoichiometric ratio. Alternatively at 438 (or at 448 at FIG. 4C), the controller may continue to monitor the ammonia content of the second exhaust catalyst. Then, when the ammonia content is greater than a second threshold level the controller may stop adjusting the air-fuel-ratio of the reactivated cylinders and return the air-fuel-ratio to stoichiometry. The second threshold level may be a level which indicates that the first exhaust catalyst is regenerated.

As described at 418 in method 400, during cylinder deactivation water may be injected with a water injection system.

FIG. 5 presents a method 500 for adjusting water injection during cylinder deactivation. In particular, an engine controller, such as controller 12, may actuate water injectors of corresponding deactivated cylinders to inject water during the cylinder deactivation. The controller may control the timing, duration, and amount of water injection.

Specifically, in response to the deactivation of one or more engine cylinders at 416 in method 400, the controller may actuate water injectors to inject an amount of water into one of the intake port, the engine cylinder, or the exhaust manifold. The location of water injection may be based on the water injection system of the engine. For example, an engine may include a direct water injection system with water injectors positioned in each engine cylinder for directly injecting water into the cylinder. In another example, the engine may include a port water injection system with water injectors positioned in an intake port of each cylinder, upstream of an intake valve, for injecting water on or near the intake valve. In yet another example, the engine may include a different port water injection system with water injectors positioned in one or more exhaust manifolds for injecting water into the exhaust manifolds.

At 502, the method may include determining an injection timing of the water injection based on the injector position. For example, water injection may occur before the opening of the intake valve if the water injectors are positioned in the intake port of the cylinder. In another example, water injection may also occur before the opening of the intake valve if the water injectors are direct water injectors positioned in the engine cylinder. In yet another example, water injection may occur before the opening of the exhaust valve if the water injectors are port water injectors positioned in the one or more exhaust manifolds.

At 504, the controller may then determine the amount of water injected for each water injection event during the cylinder deactivation (e.g., one water injection event may occur for each intake/exhaust cycle of the engine). The amount of water injected may be based on a volume of the engine cylinder. Specifically, the amount of water injected at the intake port or directly into the engine cylinder may correspond to the amount of water that may substantially fill the cylinder with water and/or water vapor. As such, this amount of water and/or water vapor may reduce the available space for air to enter the cylinder and reach the exhaust system and exhaust catalysts. A volume of water vapor formed by an amount of injected water may increase with increasing temperature. Thus, the amount of water injected at the deactivated cylinders may be based on an engine cylinder volume and intake manifold temperature (or engine temperature). The amount of water injected may be further based on additional engine operating conditions such as manifold pressure, MAP, estimated piston valve and head temperatures, and/or engine speed.

In some embodiments, the controller may also adjust valve timing of the intake and exhaust valves during the cylinder deactivation and water injection. For example, by delaying exhaust valve closing, the intake and exhaust valves may be open together (e.g., valve overlap). This may increase internal exhaust gas recirculation (EGR), thereby reducing the amount of fresh intake air entering the engine cylinder. Reducing the amount of intake air entering the cylinder may in turn reduce the amount of oxygen reaching the exhaust catalysts during cylinder deactivation. In some embodiments, increased valve overlap may be used in conjunction with water injection to reduce the total amount of water injected during the cylinder deactivation. In this embodiment, the method at 504 may include determining a valve timing adjustment to increase internal EGR. The amount of water determined at 504 may then be further based on the amount of internal EGR created by the adjusted valve timing. In this way, a larger amount of valve overlap may result in a smaller amount of water injected for each water injection event.

Moving on to 506, the controller may inject water at the one or more selectively deactivated cylinders. Thus, only the water injectors at the deactivated cylinder may inject water during the cylinder deactivation. The method at 506 may include injecting the determined amount of water at the determined timing for the duration of the cylinder deactivation. At 508, the controller may adjust the combustion air-to-fuel ratio of the activated (e.g., firing) cylinders during the selective cylinder deactivation. In one example, the controller may adjust the combustion air-to-fuel ratio of the activated cylinders to achieve a stoichiometric exhaust gas mixture. Alternatively, the controller may adjust the combustion air-to-fuel ratio of the activated cylinders to be slightly richer than stoichiometry. The combustion air-to-fuel ratio of the activated cylinders may be based on the exhaust system configuration. Alternatively, since water injection may reduce oxidation of the exhaust catalyst, thereby requiring less regeneration, the controller may adjust the combustion air-to-fuel ratio of the activated cylinders to maintain a stoichiometric exhaust regardless of the exhaust system configuration.

The methods at 506 and 508 may occur concurrently and continuously during the cylinder deactivation. At 510, the water injection may continue until cylinder reactivation conditions are met. The method then returns to 418 in method 400.

FIG. 6 shows an example of adjusting water injection and a combustion air-to-fuel ratio responsive to selective cylinder deactivation and exhaust catalyst temperature. Specifically, graph 600 shows changes between cylinder activation and deactivation at plot 602. During cylinder deactivation operation, based on engine operating conditions, one or more engine cylinders may be selectively deactivated by stopping fuel injection (e.g., fuel injector cutout) while the other cylinders remain activated. Changes in operation of a water injection system are shown at plot 604. Specifically, plot 604 may illustrate a change from not injecting water to injecting water with the water injectors at the deactivated cylinders. Further, graph 600 shows changes in gear shift during vehicle operation at plot 606, changes in exhaust catalyst temperature such as a three-way catalyst (e.g., first catalyst) at plot 608, relative to a threshold temperature 616, changes in a combustion air-to-fuel ratio (AFR) at plot 610, relative to stoichiometry 618, the ammonia content of a SCR catalyst (e.g., second catalyst) at plot 612, relative to a threshold level 620, and changes in the regeneration state of a three-way catalyst, TWC (e.g., first catalyst) at plot 614, relative to a regenerated or threshold state 622. All changes are shown over time (along the x-axis).

Prior to t1, the engine may be operating with all engine cylinders active and combusting substantially at stoichiometry 618 (plot 610). The water injectors may be turned off such that no water is injected at the engine cylinders (plot 604). As the engine operates at stoichiometry, an ammonia content of the SCR catalyst may gradually increase (plot 612). Temperature of the exhaust catalyst may also gradually increase (plot 608) while remaining lower than the threshold temperature 616. Prior to t1, the ammonia content of the SCR catalyst may be higher than the threshold level 620 and the three-way catalyst (TWC) may be in a higher state of regeneration (above threshold state 622), that is, it may not require further regeneration.

At t1, due to a change in engine operating conditions (e.g., during a transmission shift when the engine operation shifts from a higher gear ratio to a lower gear ratio), one or more engine cylinders may be selectively deactivated. The cylinders may be deactivated for a duration tx1, which may be below threshold duration of deactivation. As a result, number of water injection cycles for the deactivated cylinders may be less than a threshold number of water injection cycles. Further at t1, the exhaust catalyst temperature may be lower than the threshold (plot 608). Consequently, as a result of deactivation duration being below a threshold limit and the catalyst temperature being lower than the threshold temperature, at t1, no water may be injected at the deactivated cylinders (plot 604). The combustion air-to-fuel ratio of the active engine cylinders may be maintained substantially at stoichiometry (plot 610). By limiting water injection at deactivated cylinders based on duration of cylinder deactivation and exhaust catalyst temperature, faster switching between cylinder deactivation and reactivation (during short deactivation conditions such as transmission shift) may be achieved. During cylinder deactivation (between t1 and t2), the TWC may experience some oxidation, thereby decreasing the regeneration state of the TWC (plot 614). Additionally, the ammonia content of the SCR catalyst may decrease.

At t2, in response to cylinder reactivation conditions being met (plot 602), engine operation may be shifted back to activating the deactivated cylinders. In other words, at t2, deactivated cylinders may be reactivated upon completion of the transmission shift. In addition, to regenerate the TWC, a combustion air-to-fuel ratio (plot 610) may be enriched for a duration d1 to bring the regeneration state of the TWC (plot 614) above the threshold state 622. The degree of richness of the rich fuel injection is adjusted based on the ammonia storage content (plot 612) of the SCR catalyst. Herein, since the ammonia content is below the threshold level 620 upon reactivation of the cylinders, a rich fuel injection of a higher rich bias of a duration d1 is used to regenerate the TWC. While the TWC is being regenerated, the ammonia stored on the SCR catalyst may be consumed to reduce exhaust NOx species, such that an exhaust NOx level at the time of shift from cylinder deactivation to cylinder reactivation is substantially maintained. However, as the cylinder continue to combust the richer air-to-fuel ratio, the ammonia content of the SCR catalyst may begin to increase before t3. At t3, regeneration state of TWC may be higher than the threshold and consequently, the combustion air-to-fuel ratio of the reactivated cylinders may return to stoichiometry 618. Further, between t2 and t3, exhaust catalyst temperature (plot 608) may gradually increase while remaining below the threshold 616.

At t4, another change in engine operating conditions may occur causing one or more engine cylinders to be selectively deactivated. For example, based on tip out, and brake application by a vehicle operator, the controller may command a deceleration fuel shut-off operation at selected cylinders. The deceleration fuel-shut off may occur for a duration ty greater than the threshold duration of deactivation. As a result, in response to the cylinder deactivation duration being greater than a threshold, water may be injected by the water injectors at the deactivated engine cylinders (plot 604). Again, the combustion air-to-fuel ratio of the active cylinders may remain at stoichiometry 618 (plot 610). During the cylinder deactivation, between t4 and t5, the ammonia content of the SCR catalyst may decrease slightly but remain above the threshold level 620 (plot 612) and the regeneration state of the TWC may also decrease but may remain above or at the threshold state 622 (plot 614). As such, NOx emission level may be maintained. Further, by performing water injection at the deactivated cylinders, temperature of the exhaust catalyst (608) may be maintained below the threshold 616. These changes in ammonia content of the SCR catalyst, and regeneration state of TWC, may be less than if no water injection was used during the cylinder deactivation.

Next, at t5, upon cylinder reactivating conditions being met (such as completion of deceleration fuel shut-off operation), the engine controller may reactivate the deactivated cylinders. Since the ammonia content of the SCR catalyst is greater than the threshold level 620 at t5, the combustion air-to-fuel ratio of the reactivated cylinders may have a lower rich bias. In the example, shown in graph 600, the lower rich bias may be small such that the combustion air-to-fuel ratio of the reactivated cylinders is only slightly lower than stoichiometry 618. As shown at from t4 to t5, water injection reduced the oxidation of the TWC and the reduction of ammonia. Thus, less rich bias was required when reactivating the cylinders, thereby reducing the fuel penalty to the engine. If no water injection had been used between t4 and t5, a larger rich bias would have been required at t5 to regenerate the exhaust catalyst.

Between t5 and t6, the engine may continue to operate all the cylinders. Since the combustion AFR is operated lean, ammonia content of the SCR catalyst may decrease to a threshold level and the regeneration state of the TWC may also decrease to a state just below the threshold. Further, the catalyst temperature may gradually increase while remaining below the threshold. Next, between t6 and t7, due to no change in engine operating conditions, the engine may further continue to operate all the cylinders. The combustion AFR may be operated rich to restore the regeneration state of TWC to a state above the threshold. Consequently, ammonia stored at the SCR catalyst may initially be consumed to reduce the NOx species, and may increase before t7. Further, between t6 and t7, as the engine continues to combust fuel causing more exhaust gases to pass through the catalyst, the catalyst temperature may increase to a level above the threshold temperature. At t7, another change in engine operating condition, such as a second transmission shift in this example, may cause the controller to deactivate one or more cylinders. The selected cylinders may be deactivated for a duration tx2 lower than the threshold. However, since the temperature of the exhaust catalyst at t7 is higher than the threshold temperature, even though the duration of deactivation is lower than the threshold duration for water injection, water may be injected at deactivated cylinders to bring the temperature of catalyst below the threshold 616. By injecting water at the deactivated cylinders, catalyst temperature may be reduced, thereby preventing catalyst degradation. Further, by performing water injection, decrease in ammonia content of SCR and regeneration state of TWC, may also be reduced. In other words, ammonia content of the SCR catalyst may be maintained above the threshold limit, and a regeneration state of TWC may also be maintained at or above the threshold limit.

At t8, upon cylinder reactivation conditions being met, water injection may be terminated at the deactivated cylinders and the deactivated cylinders may be activated. Further, at t8, the catalyst temperature is below the threshold, ammonia content of the SCR catalyst is above the threshold, and the regeneration state of TWC is at threshold. Between t8 and t9, the engine operates all the cylinders with combustion AFR at stoichiometry.

Next, at t9, engine operating conditions may indicate a cylinder misfire. Upon detecting the misfire, the controller may deactivate the misfiring cylinder. During FMEM, duration of misfiring cylinder deactivation tz may be estimated to be greater than the threshold for water injection. Consequently, water may be injected at the deactivated cylinder. In this way, by injecting water at the misfiring cylinder, excessive increase in catalyst temperature may be controlled, and excess air could be prevented from entering the exhaust and oxidizing the catalyst.

It will be appreciated that while the example of FIG. 6 is explained with reference to cylinder deactivation events such as transmission shift, DFSO, and cylinder misfire, in an alternate example, cylinder deactivation with water injection may be applied to start-stop transients for engine speed flare control. By using cylinder deactivation with water injection, exhaust catalyst temperature may be controlled and oxidation of exhaust catalyst may be reduced. As a result, exhaust catalyst degradation may be prevented, and emissions may be controlled. Consequently, fuel economy may be improved.

In this way, one or more engine cylinders may be selectively deactivated via deactivatable fuel injectors. Then, water may be injected at the one or more deactivated engine cylinders during deactivation. Injecting water may reduce an amount of oxidation of an exhaust catalyst, such as a three-way catalyst (TWC), and control excessive increase in catalyst temperature. Upon reactivation of the one or more deactivated engine cylinders, a combustion air-to-fuel ratio may be decreased, or enriched, in order to regenerate the three-way catalyst. However, less regeneration may be required due to the water injection during the deactivation event. The ammonia content of another exhaust catalyst, such as an SCR catalyst, may indicate how much regeneration is required and subsequently the required degree of richness of the combustion air-to-fuel ratio during cylinder reactivation.

As shown at t2 in FIG. 6, during a first cylinder reactivation, when an ammonia content of an exhaust catalyst is lower than a threshold, a controller may adjust an engine combustion air-to-fuel ratio to be richer than stoichiometry with a first, higher rich bias. During a second reactivation of the cylinders, as shown at t5, when the ammonia content of the exhaust catalyst is higher than the threshold, adjusting the engine combustion air-to-fuel ratio to be richer than stoichiometry with a second, lower rich bias. As shown between t2 and t3, during each of the first and second cylinder reactivations, the adjusting the engine combustion air-to-fuel ratio is continued for a duration based on the ammonia content of the exhaust catalyst. In another example, duration d1 may be shorter if the ammonia continent of the SCR catalyst is greater than shown at t2 in FIG. 6.

As discussed above, injecting water at the one or more deactivated engine cylinders includes one of injecting water at an intake port, upstream of an intake valve of the one or more deactivated engine cylinders, injecting water directly into the one or more deactivated engine cylinders, or injecting water at an exhaust manifold of the one or more deactivated engine cylinders. An injection timing of water injection may then be determined based on a position of the water injection. Further an amount of water injected during the injecting water may be determined based on one or more of an engine cylinder volume, engine temperature, engine speed, and a manifold pressure and wherein the amount of water injected increases with increasing cylinder volume and decreasing engine temperature.

Returning to FIG. 6, as shown between t1 and t2 and between t4 and t5, during the selectively deactivating one or more engine cylinders, fuel injection of active engine cylinders may be adjusted to maintain a stoichiometric air-to-fuel ratio. In alternate example, fuel injection of the active engine cylinders may be adjusted to maintain an air-to-fuel ratio slightly richer than stoichiometry. Finally, as shown at t5 and t7, water injection may be stopped when the one or more deactivated cylinders are reactivated.

In this way, during an engine cylinder deactivation event, injecting water at the selectively deactivated engine cylinders may reduce the amount of oxygen traveling to the exhaust system and reaching a first exhaust catalyst and a second exhaust catalyst. In one example, in response to cylinder deactivation, one or more water injectors may inject water into an intake port of one or more deactivated engine cylinders. Then, upon reactivation of the engine cylinders, a combustion air-to-fuel ratio of the reactivated cylinders may be adjusted based on the ammonia content of the second exhaust catalyst. Specifically, a combustion air-to-fuel ratio with a lower rich bias may be used to regenerate the first exhaust catalyst if the ammonia content is greater than a threshold level. Alternatively, a combustion air-to-fuel ratio with a higher rich bias may be used to regenerate the first exhaust catalyst if the ammonia content of the second exhaust catalyst is less than the threshold level. Water injection may help to decrease the required amount of exhaust catalyst regeneration and may prevent excessive increase in exhaust catalyst temperature. In this way, injecting water during engine cylinder deactivation may reduce fuel penalty of the engine, and reduce catalyst degradation due to increased catalyst temperatures, while also maintaining a required NOx level.

In an embodiment, an engine method may comprise selectively deactivating one or more engine cylinders via deactivatable fuel injectors in response to engine misfire in those one or more engine cylinders; and during the cylinder deactivation, injecting water at the one or more deactivated engine cylinders to reduce oxygenation of a first exhaust catalyst.

Note that an integrated method may be provided in an embodiment for performing water injection under each of a plurality of operation conditions. For example, one embodiment may include a method, comprising:

during engine misfire conditions, selectively deactivating one or more engine cylinders via deactivatable fuel injectors in response to engine misfire in those one or more engine cylinders; and during the cylinder deactivation, injecting water at the one or more deactivated engine cylinders to reduce oxygenation of a first exhaust catalyst;

during transient transmission conditions, selectively deactivating one or more engine cylinders via deactivatable fuel injectors during a transmission event; and during the cylinder deactivation, injecting water at the one or more deactivated engine cylinders to reduce oxygenation of a first exhaust catalyst; and during a stop-start engine restart from rest, selectively deactivating one or more engine cylinders via deactivatable fuel injectors during an engine run-up of a start from rest; and during the cylinder deactivation, injecting water at the one or more deactivated engine cylinders to reduce oxygenation of a first exhaust catalyst, wherein the water injection in each of the conditions is based on an amount of water injected in the other conditions so as to avoid over-injection of water. In this way, water injection may be coordinated among a plurality of conditions.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

estimating a duration of cylinder deactivation;

determining a number of available water injection cycles based on the estimated duration of cylinder deactivation;

determining that the available water injection cycles is greater than a threshold;

selectively deactivating one or more engine cylinders via deactivatable fuel injectors during a transmission shift event when the available water injection cycles is greater than the threshold; and during the cylinder deactivation, reducing oxygenation of a first exhaust catalyst by injecting water at the one or more deactivated engine cylinders via one or more water injectors at each deactivated engine cylinder.

2. The method of claim 1, wherein during cylinder deactivation, injecting water at the one or more cylinders includes injecting water at the one or more cylinders if an exhaust catalyst temperature is greater than a threshold.

3. The method of claim 1, wherein the estimated duration of cylinder deactivation is based on one or more engine operating conditions.

4. The method of claim 1, wherein the transmission shift event includes a transmission shift event in an automatic transmission.

5. The method of claim 1, wherein the transmission shift event includes a transmission shift event in a manual transmission.

6. The method of claim 1, wherein the transmission shift event includes shifting from a higher gear ratio to a lower gear ratio.

7. The method of claim 1, further comprising, during the injection of water, adjusting an amount of water injected based on one or more of an engine volume, engine temperature, engine speed, and a manifold pressure.

8. The method of claim 1, further comprising stopping water injection in response to reactivating one or more deactivated engine cylinders.

9. The method of claim 8, further comprising adjusting a combustion air-to-fuel ratio of the reactivated engine cylinders based on an ammonia content stored in a second exhaust catalyst, wherein the combustion air-to-fuel ratio decreases with decreasing ammonia content.

10. An engine method, comprising:

estimating a duration of cylinder deactivation;

determining a number of available water injection cycles based on the estimated duration of cylinder deactivation;

determining that the available water injection cycles is greater than a threshold;

selectively deactivating one or more engine cylinders via deactivatable fuel injectors during an engine start when the available water injection cycles is greater than the threshold; and during the cylinder deactivation, reducing oxygenation of a first exhaust catalyst by injecting water at the one or more deactivated engine cylinders via one or more water injectors at each deactivated engine cylinder.

11. The method of claim 10, wherein injecting water at the one or more deactivated engine cylinders is based on a number of water injection cycles, and further based on an exhaust catalyst temperature.

12. The method of claim 10, wherein the selective deactivating is during an engine restart from rest of a stop-start engine with a torque converter at least partially unlocked, and is responsive to an engine speed during run-up greater than a threshold.

13. The method of claim 10, further comprising adjusting an injection timing of water injection based on operating conditions.

14. The method of claim 10, further comprising stopping injecting water when the one or more deactivated cylinders are reactivated.

15. An engine method, comprising:

estimating a duration of cylinder deactivation;

determining a number of available water injection cycles based on the estimated duration of cylinder deactivation;

determining that the available water injection cycles is greater than a threshold;

selectively deactivating one or more engine cylinders via deactivatable fuel injectors during deceleration fuel shut-off when the available water injection cycles is greater than the threshold; and during the cylinder deactivation, reducing oxygenation of a first exhaust catalyst by injecting water at the one or more deactivated engine cylinders via one or more water injectors at each deactivated engine cylinder.

16. The method of claim 1, further comprising adjusting an amount of water injected during the injecting water based on one or more of an engine volume, engine temperature, engine speed, a manifold pressure, and an exhaust gas oxygen level, and adjusting a rich bias upon reactivation based on the amount of water injected.

17. The method of claim 15, wherein injecting water at the one or more deactivated cylinders is based on a number of water injection cycles, and further based on a first exhaust catalyst temperature.

18. The method of claim 15, further comprising stopping water injection, reactivating the one or more deactivated engine cylinders, and adjusting a combustion air-fuel ratio of the reactivated engine cylinders based on an ammonia content stored in a second exhaust catalyst.

* * * * *